United States Patent [19]

Billen

[11] Patent Number: 4,486,981

[45] Date of Patent: Dec. 11, 1984

[54] REFRIGERATOR DOOR

[75] Inventor: Kurt Billen, Körperich, Fed. Rep. of Germany

[73] Assignee: Electrolux S.a.r.l., Vianden, Luxembourg

[21] Appl. No.: 486,950

[22] PCT Filed: Jun. 19, 1982

[86] PCT No.: PCT/EP82/00128

§ 371 Date: Feb. 22, 1983

§ 102(e) Date: Feb. 22, 1983

[87] PCT Pub. No.: WO83/00212

PCT Pub. Date: Jan. 20, 1983

[30] Foreign Application Priority Data

Jun. 30, 1981 [SE] Sweden ..... 8104080

[51] Int. Cl.[3] ..... E06B 3/00

[52] U.S. Cl. ..... 49/501; 49/382; 49/388; 49/460; 49/478

[58] Field of Search ..... 49/388, 382, 460, 501, 49/478; 312/138 A, 214, 138 R

[56] References Cited

U.S. PATENT DOCUMENTS

| | | | |
|---|---|---|---|
| 3,314,196 | 4/1967 | Betz et al. | 49/501 |
| 3,378,954 | 4/1968 | Sandin | 49/388 X |
| 3,533,190 | 10/1970 | Hilfinger et al. | 49/501 |
| 3,555,733 | 1/1971 | Horgan, Jr. | 49/388 |
| 3,863,391 | 2/1975 | Horvay et al. | 49/460 X |
| 4,145,844 | 3/1979 | Kaspar | 49/501 X |
| 4,151,681 | 5/1979 | Roberts | 49/382 |

FOREIGN PATENT DOCUMENTS

| | | |
|---|---|---|
| 1402394 | 5/1965 | France . |
| 1475604 | 2/1967 | France . |
| 2132720 | 11/1972 | France . |
| 838358 | 6/1960 | United Kingdom . |
| 1333118 | 10/1973 | United Kingdom . |
| 2024903 | 1/1980 | United Kingdom . |

*Primary Examiner*—Philip C. Kannan
*Attorney, Agent, or Firm*—Alfred E. Miller

[57] ABSTRACT

A refrigerator door of joint parts, an outer shell, an inner door lining and heat insulation. A top frame part and a bottom frame part have a bushing at their ends for a pivot pin or a hinge, the bushing being insertable in a sleeve on a side part of the frame. Thus, the refrigerator door is fabricated at a lower cost than previous similar constructions.

7 Claims, 11 Drawing Figures

REFRIGERATOR DOOR

This invention relates to a refrigerator door having a frame of joined parts, an outer shell, an inner door lining and a heat insulation.

Doors which have been in existence for a long time usually have several metal members which are, for example, fabricated of aluminum, as well as various attachment means and special fittings for the door hinges. Many refrigerators are provided with hinge fittings at both vertical sides of the door so that the buyer can choose whether the hinges should be at the right or at the left side of the door. Therefore, special fittings have to be attached to the four corners of the door. Further included are an outer shell, an inner door lining and possibly also special door handles. Such a door calls for much work in assembling all the parts included and in some cases also laquering of the frame in a special device for the purpose. In the latter case additional costs for transport to and from the laquering device and through it are involved. As a result, the door will be comparatively expensive in manufacture.

The object of the invention is to provide a refrigerator door at a lower cost than earlier. This can be achieved according to the invention in a door whose top and bottom frame parts at their ends have a bushing for a pivot pin of a hinge, the bushing being insertible in a sleeve on a side part of the frame.

The invention will be described in detail below with reference to a refrigerator door shown in the drawings.

Figure 1:
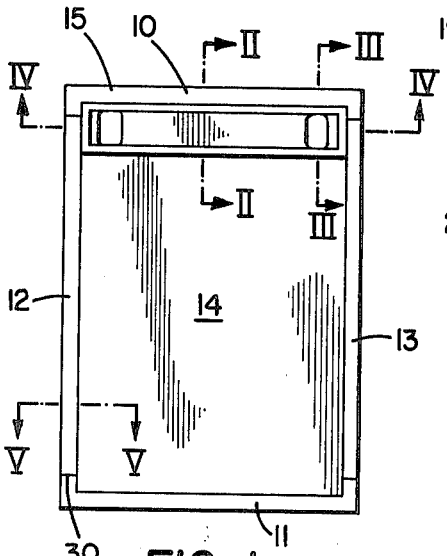
FIG. 1 is a front view of the door.

The refrigerator door shown in the Figures comprises a frame with a top part 10, an inverted bottom part 11 of equal shape, a side part 12 to the left and an inverted side part 13 of equal shape to the right. Before these parts are joined a front plate 14 and a handle part 15 are inserted in the frame.

Figure 2:
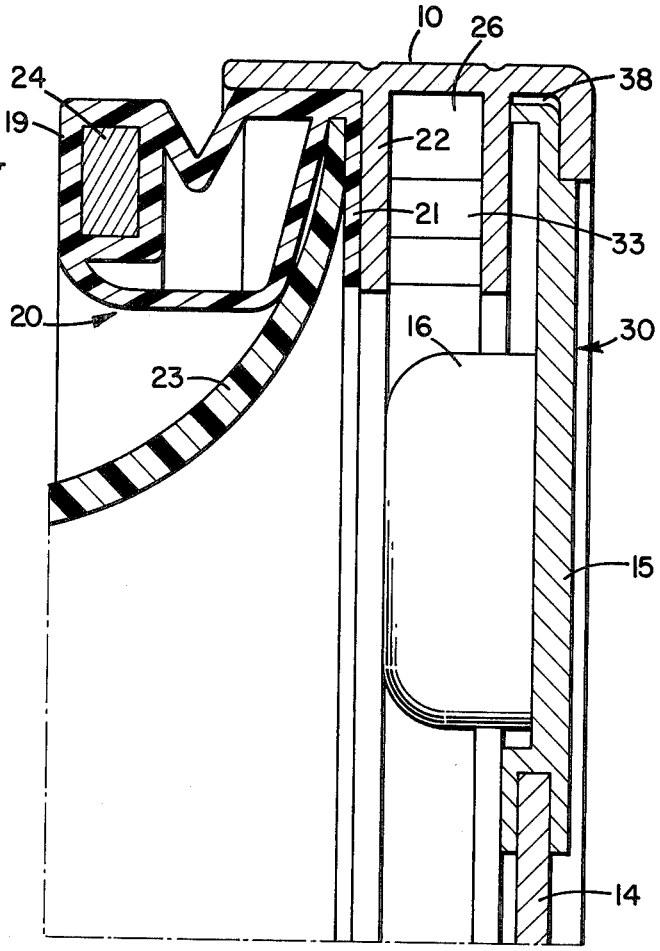
FIG. 2 is a vertical section through the door on the line II—II of FIG. 1.
Figure 4:
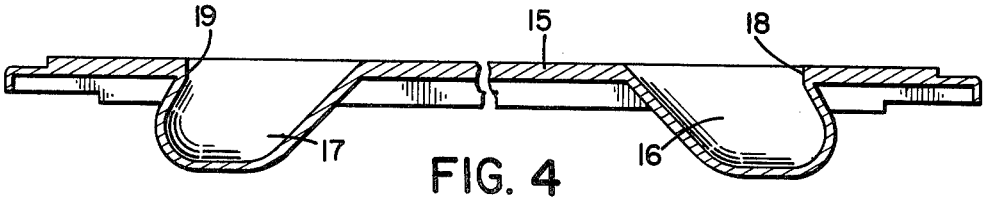
FIG. 4 is a horizontal section through a part of the handle on the line IV—IV of FIG. 1.
Figure 5:
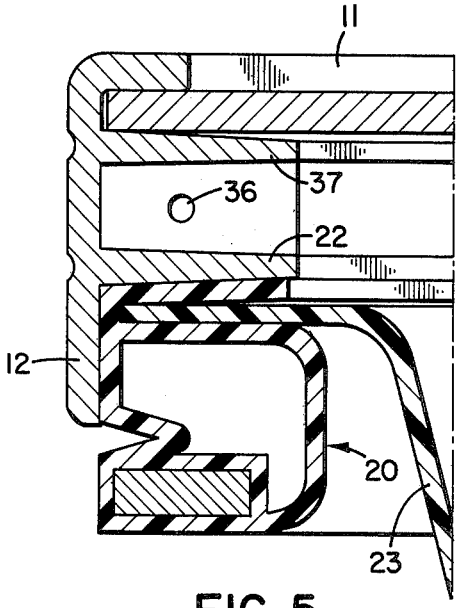
FIG. 5 is a horizontal section through the door frame on the line V—V of FIG. 1.

In the vertical section of FIG. 2 the top part 10, the side part 13, the front plate 14 and the handle part 15 are seen. The latter is shown separately in FIG. 4 in which it can be seen that it has a recess 16, 17 which extends obliquely inwards and has a grip edge 18, 19. When the hinges of the door are on the right side, the edge 19 is used to open and close the door and when the hinges are on the left side of the door the edge 18 is used.

On the inner face of the frame a sealing strip 20 is arranged with a flange 21 between an inner frame flange 22 and an inner door lining 23. The sealing strip 20 is elastic and includes in a known manner a magnetic strip 24. The parts are joined, for example by polyurethane which is foamed in situ in the door.

Figure 3:
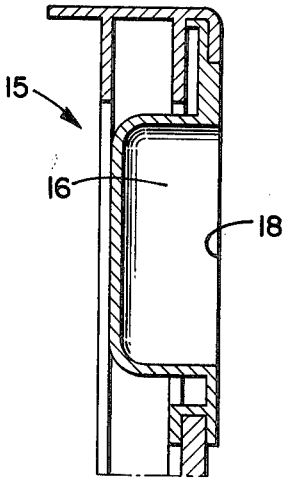
FIG. 3 is a similar vertical section on the line III—III of FIG. 1.

FIG. 3 shows the same parts as FIG. 1 but in another section which extends through the recess 16 in the handle part 15 with grip edge 18.

Figure 6:
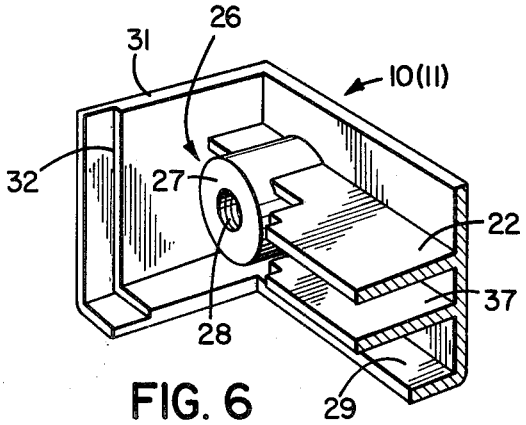
FIGS. 6 and 7 are two different perspective views of one end of a lower or an upper frame part.
Figure 7:
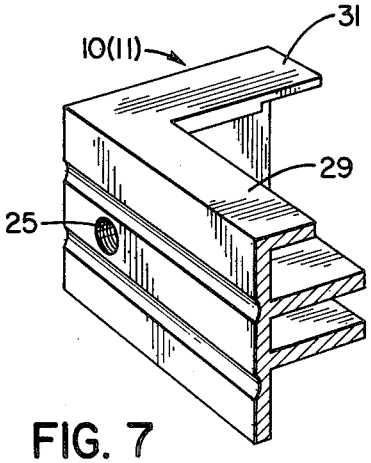
Figure 9:
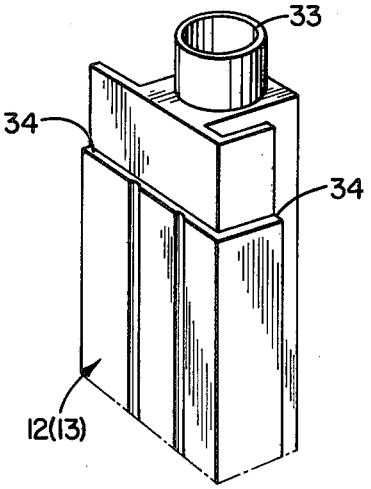
FIGS. 8 and 9 are perspective views of each end of a side part of the frame.
Figure 8:
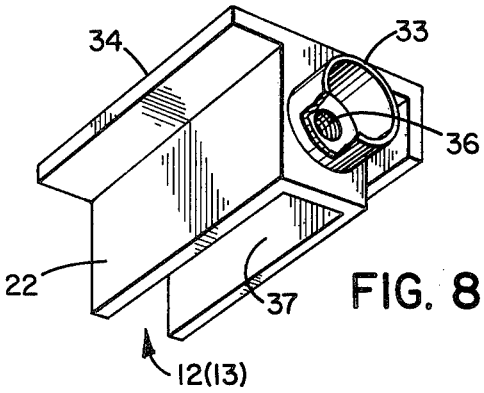

In FIGS. 6–9 the corners of the door are shown in different views. Thus, FIG. 6 is a perspective view interiorly of the lower left corner or the upper right corner of the door of FIG. 1, and FIG. 7 is the same corner seen from the exterior. Thus it appears from FIG. 7 that the top and bottom frame parts have holes 25 in the frame part 10 or 11 in a part formed as a bearing bushing 26 interiorly of the frame. The bushing 26 is in the shape of a cylinder, the hole 25 being intended to receive a bearing pin. The cylinder has a bottom 27 with an aperture 28. The frame parts are die-casted of a suitable plastics material and are so shaped that the top and the bottom frame parts 10, 11, extend around the corners of the frame. The frame parts have a front flange 29 with joints 30 between the parts and situated on the vertical sides (FIG. 1) of the frame. Vertical parts 31 at either end of the top and the bottom frame parts form part of the vertical sides of the frame and have an inner step 32. The side parts 12, 13 are of similar shape. Both ends of a frame part are shown in FIGS. 8 and 9. The end of the side part 12 shown in FIG. 8 fits to that end of the top frame part 10 which is shown in FIG. 6. At its end the side part 12 has a projecting sleeve 33 in which the bushing 26 of the top part is insertible on joining of the parts. Exteriorly, the side parts 12, 13 form an angle, as is best seen in FIG. 9, with an exterior step 34. The frame parts can thus be joined with a very stable fit. Safe fixing of the parts can be obtained by means of a screw 35 or other attachment through the aperture 28 in the bottom 27 of the bushing 26 and a hole 36 in the side part of the frame.

Inside of the front flange 29 of the frame parts a reinforcing flange 37 is provided. Between the flange 37 and the front flange 29 there is formed a groove 38 for the exterior front plate 14 and also for a handle part 15, if such a part is used.

Figure 10:
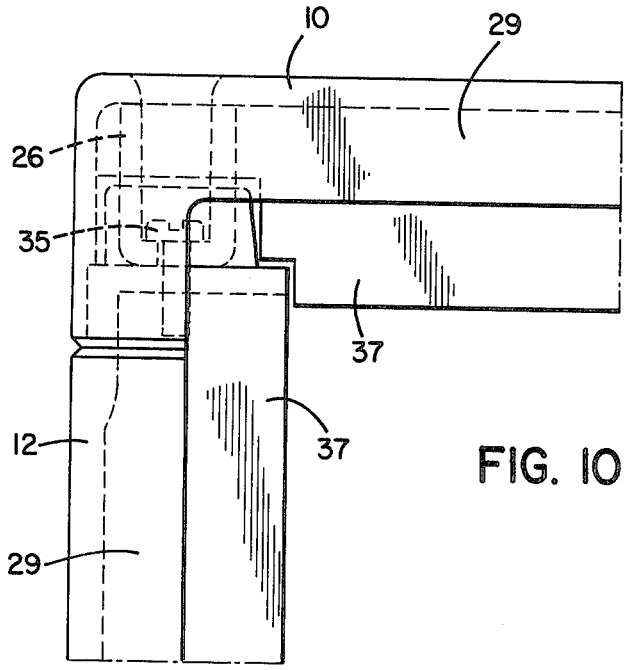
FIG. 10 shows an upper frame corner, seen from the front.
Figure 11:
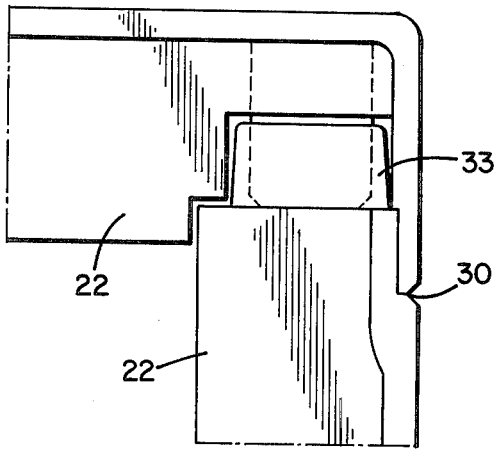
FIG. 11 shows the same frame corner, seen from behind, in both cases without outer shell and inner door lining.

FIGS. 10 and 11 show to an enlarged scale an upper frame corner without outer shell and door lining. In FIG. 10, which shows the frame seen from the front, the dashed lines indicate a bushing 26 and a screw 35 running therein and threaded in the hole 36 in the side part 12 of the frame. The same parts seen from behind or from the inside of the door appear in FIG. 11.

I claim:

1. A refrigerator door having a frame of joined parts, an outer shell, an inner door lining and heat insulation, characterized in that a top frame part (10) and a bottom frame part (11) at their ends having a bushing (26) for a pivot pin of a hinge, the bushing (26) being insertible in a sleeve (33) on a side part (12,13) of the frame.

2. A door according to claim 1, characterized in that each one of the bushing (26) and the sleeve (33) has a bottom (27) with a hole (28,36) for a screw (35).

3. A door according to claim 1, characterized in that the top part (10) and the bottom part (11) of the frame are of equal shape.

4. A door according to claim 1, characterized in that the two side parts (12,13) of the frame are of equal shape.

5. A door according to claim 1, characterized in that the frame parts (10–13) are moulded of plastics.

6. A door according to claim 1, characterized in that the frame parts (10–13) form four door sides and have a front flange (29) at such a distance from the bushings (26) that a groove (38) for a front plate (14) is formed.

7. A door according to claim 6, characterized in that a part of the front plate (14) is replaced by a handle part (15) having a groove facing the plate (14) and corresponding to the groove in the frame (10–13).

* * * * *